US009439458B2

(12) United States Patent
Hughes

(10) Patent No.: US 9,439,458 B2
(45) Date of Patent: Sep. 13, 2016

(54) SYSTEM AND METHOD FOR AN IMPROVED APPEARANCE OF A PAIR OF PANTS

(71) Applicant: JoElla Hughes, Arlington, TX (US)

(72) Inventor: JoElla Hughes, Arlington, TX (US)

( * ) Notice: Subject to any disclaimer, the term of this patent is extended or adjusted under 35 U.S.C. 154(b) by 464 days.

(21) Appl. No.: 13/621,850

(22) Filed: Oct. 8, 2012

(65) Prior Publication Data

US 2014/0096309 A1 Apr. 10, 2014

(51) Int. Cl.

| | |
|---|---|
| ***A41D 1/00*** | (2006.01) |
| ***A41D 1/06*** | (2006.01) |
| *A41D 27/06* | (2006.01) |
| *A41D 27/20* | (2006.01) |

(52) U.S. Cl.

CPC ..... *A41D 1/06* (2013.01); *A41D 27/06* (2013.01); *A41D 27/204* (2013.01)

(58) Field of Classification Search

CPC ..... A41D 1/06; A41D 1/067; A41D 1/10; A41D 27/204; A41D 27/06

USPC ..... 2/227, 231, 240, 241, 247–256, 258, 2/260, 261, 267

See application file for complete search history.

(56) References Cited

U.S. PATENT DOCUMENTS

| | | | | |
|---|---|---|---|---|
| 5,497,511 | A * | 3/1996 | Zade | 2/22 |
| 5,733,335 | A * | 3/1998 | Ishikawa et al. | 623/7 |
| 6,182,297 | B1 * | 2/2001 | Duren et al. | 2/228 |
| 7,089,601 | B2 * | 8/2006 | Chen | 2/400 |
| 2006/0015987 | A1 * | 1/2006 | Anderson | 2/247 |
| 2006/0179545 | A1 * | 8/2006 | Arensdorf et al. | 2/227 |
| 2009/0031469 | A1 * | 2/2009 | Christensen et al. | 2/69 |
| 2012/0216337 | A1 * | 8/2012 | Nelson | A41B 9/04 2/400 |

* cited by examiner

*Primary Examiner* — Khaled Annis
(74) *Attorney, Agent, or Firm* — Karl L. Larson

(57) ABSTRACT

A system and method for an improved appearance of a pair of pants. The system includes a pair of pants having one or more rear pant pockets, and one or more pant inserts configured to be inserted into and engage respective one or more rear pant pockets during an operational use thereof such that the one or more pant inserts straighten or take out the creases in the general area of the respective one or more rear pant pockets to improve the general appearance of the pair of pants when worn by a user. The one or more pant inserts include a wearable fabric layer, a first fusible or bonding product layer, a stiff utility material layer, and a second fusible or bonding product layer bonded together.

14 Claims, 15 Drawing Sheets

SYSTEM AND METHOD FOR AN IMPROVED APPEARANCE OF A PAIR OF PANTS

BACKGROUND OF THE INVENTION

1. Field of the Invention

The present invention is generally related to fashion, and more particularly to a system and method for an improved appearance of a pair of pants.

2. Discussion of the Background

A pair of pants is typically comprised of a wearable fabric and includes one or more (typically two) rear pockets also typically comprised of the same wearable fabric. One problem with most types of pants is that the underwear edge or hem line is visible through the rear side of the pants. This is especially true where the underwear has a thicker edge or hem line at the bottom just under the buttocks, such as underwear made of 100% cotton. Another problem with most types of pants is that indentations on the outer side of a user's buttocks towards the hips are typically visible through on the rear side the pants.

Thus, there currently exist deficiencies associated with a pair of pants, and, in particular, with the cosmetic appearance associated with a pair of pants.

SUMMARY OF THE INVENTION

Accordingly, one aspect of the present invention is to provide a system for an improved appearance of a pair of pants. The system includes a pair of pants having one or more rear pant pockets, and one or more pant inserts configured to be inserted into and engage respective one or more rear pant pockets during an operational use thereof such that the one or more inserts straighten or take out the creases in the general area of the respective one or more rear pant pockets to improve the general appearance of the pair of pants when worn by a user. The one or more pant inserts include a wearable fabric layer, a first fusible or bonding product layer, a stiff utility material layer, and a second fusible or bonding product layer bonded together.

Another aspect of the present invention is to provide a system for an improved appearance of a pair of pants. The system includes a pair of pants having one or more rear pant pockets, and one or more pant inserts configured to be inserted into and engage respective one or more rear pant pockets during an operational use thereof such that the one or more pant inserts straighten or take out the creases in the general area of the respective one or more rear pant pockets to improve the general appearance of the pair of pants when worn by a user. The one or more pant inserts comprise a wearable fabric layer and a stiff utility material layer bonded together.

Yet another aspect of the present invention is to provide a method for an improved appearance of pair of pants having at least one rear pocket. The method includes (i) heat bonding a side of the first fusible or bonding product layer with a side of the wearable fabric layer, (ii) heat bonding a side of the stiff utility material layer with an opposite side of the first fusible or bonding product layer, (iii) heat bonding a side of the second fusible or bonding product layer with an opposite side of the stiff utility material layer. The heat bonded wearable fabric layer, first fusible or bonding product layer, stiff utility material layer, and second fusible or bonding product layer form a pant insert. The method further includes (iv) inserting the pant insert into the at least one rear pocket of the pair of pants. The pant insert is configured to straighten or take out the creases in the general area of at least one rear pant pocket to improve the general appearance of the pair of pants when worn by a user.

Another aspect of the present invention is to provide an insert for use with an article of clothing. The insert includes an insert for use with an article of clothing and configured to straighten or take out the creases on the article of clothing in the general area of the insert when in contact with the article of clothing during an operational use thereof, the insert comprising a wearable fabric layer, a first fusible or bonding product layer, a stiff utility material layer, and a second fusible or bonding product layer bonded together. The wearable fabric layer comprises at least one selected from the group consisting of denim, twill, canvas, limen, silk, rayon, wool, satin, polyester, and cotton. The first fusible or bonding product layer and second fusible or bonding product layer comprise at least one selected from the group consisting of a sheet of material and an adhesive, a bonding agent, and a fusible web. The stiff utility material layer comprises a stiffening material configured to maintain form while having flexibility and stiffness.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION OF THE PREFERRED EMBODIMENTS

Figure 1A:
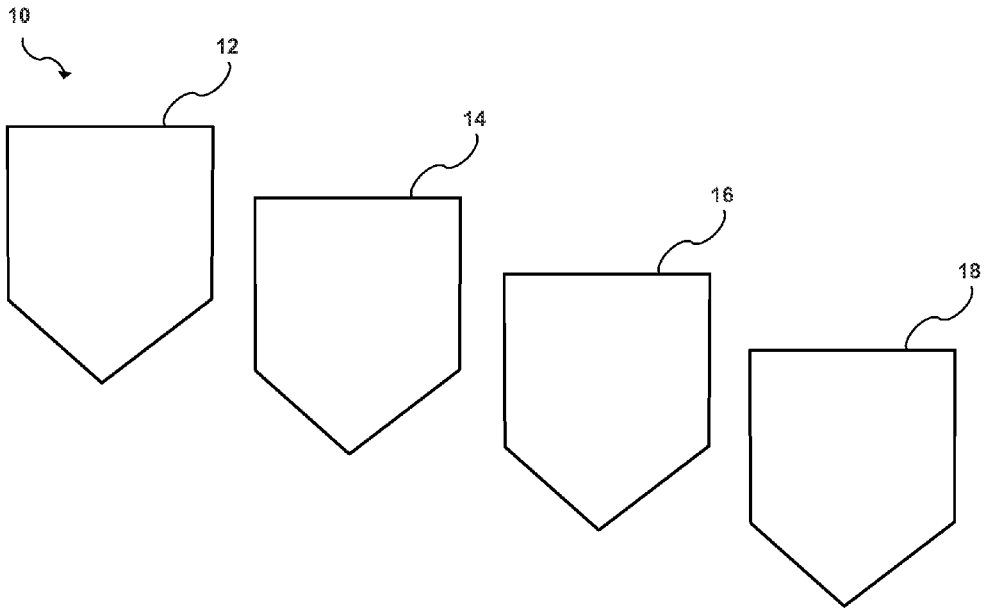
FIG. 1A shows a top plan view of one or more pant insert layers in accordance with an embodiment of the present invention.
Figure 1B:
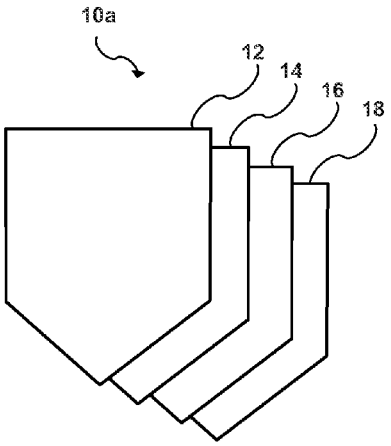
FIG. 1B shows an exploded top plan view of a pant insert having one or more pant insert layers in accordance with an embodiment of the present invention.
Figure 1C:
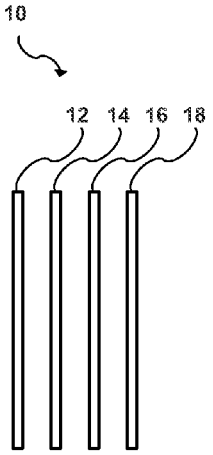
FIG. 1C shows an exploded side view of a pant insert having one or more pant insert layers in accordance with an embodiment of the present invention.

Referring now to the drawings, wherein like reference numerals designate identical or corresponding parts throughout the several views, preferred embodiments of the present invention are described.

A pair of pants is typically comprised of a wearable fabric and includes one or more (typically two) rear pockets typically comprised of the same wearable fabric. One problem with most types of pants is that the underwear edge or hem line is visible through the rear side of the pair of pants. This is especially true for underwear with a thicker edge or hem line at the bottom just under the buttocks, such as underwear made of 100% cotton. Another problem with most types of pants is that indentations on the outer side of a user's buttocks towards the hips are visible through on the rear side the pair of pants.

I. Pant Inserts

After many experiments using several different fabrics, materials, products and sizes, the present invention of a pant insert of appropriate fabric, material, product and size was eventually determined which concealed the underwear edge or hem line and user indentions by rounding out the buttock area with a natural rounded look. Without limitation, the present invention of the pant insert: conceals the underwear line; conceals buttock indentations; is easy to use; is comfortable; stays in place; is reusable; is sized to custom fit; is washable; is durable; has a natural look; may be configured as either removable or permanent; benefits younger and older users; and is unisex.

Figure 5A:
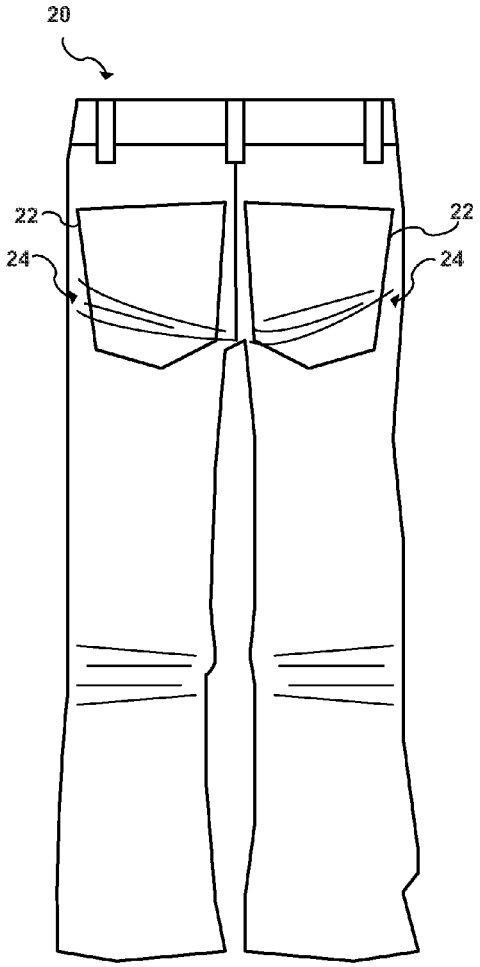
FIG. 5A shows a top plan view of a pair of pants having one or more wrinkles and/or indentations in accordance with an embodiment of the present invention.
Figure 5B:
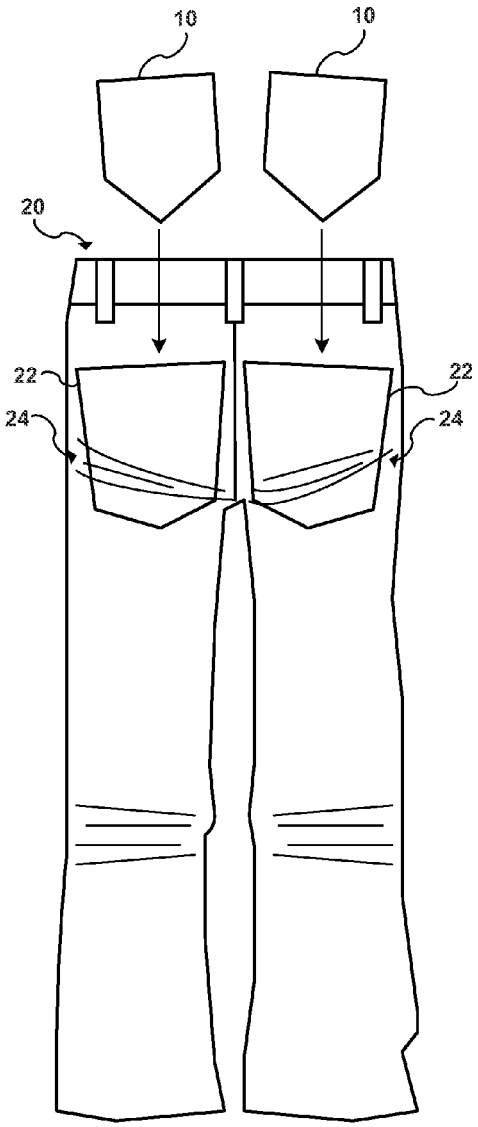
FIG. 5B shows a top plan view of a pair of pants having one or more wrinkles and/or indentations, and one or more pant inserts in a non-operational position in accordance with an embodiment of the present invention.

Referring to FIGS. 5A and 5B, top plan views of a pair of pants 20 having one or more wrinkles and/or indentations, and one or more pant inserts 10 in a non-operational position in accordance with an embodiment of the present invention are shown. As shown, the pair of pants 20 includes one or more wrinkles and/indentations 24 when the one or more pant inserts 10 are either not used or in a non-operational position.

Figure 5C:
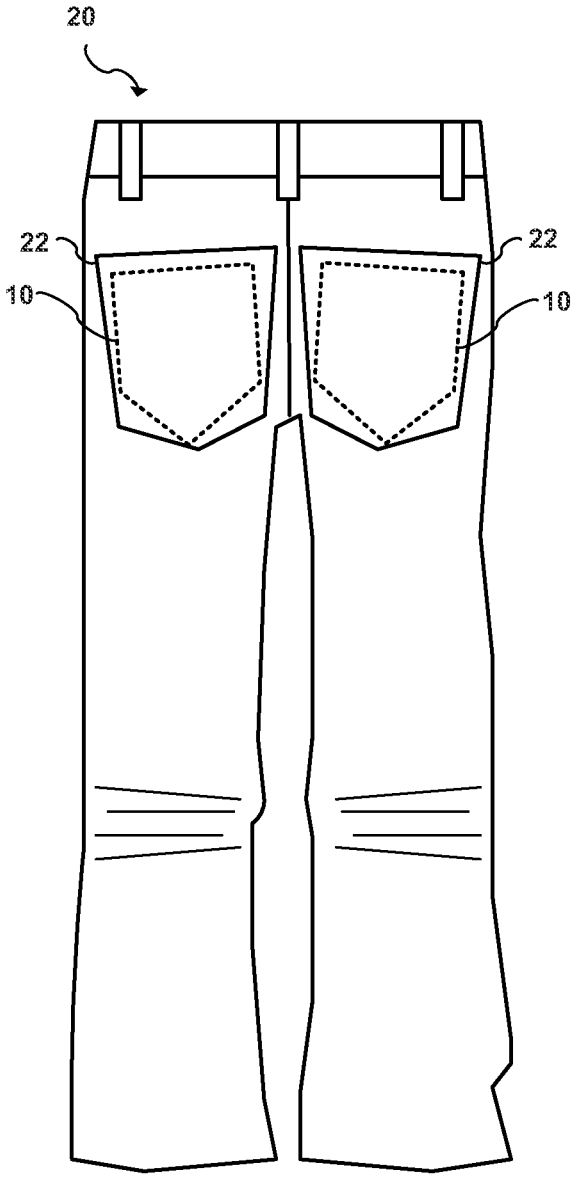
FIG. 5C shows a top plan view of a pair of pants without one or more wrinkles or indentations, and one or more pant inserts in an operational position in accordance with an embodiment of the present invention.

Referring to FIG. 5C, a top plan view of a pair of pants 20 without one or more wrinkles and one or more pant inserts 10 in an operational position in accordance with an embodiment of the present invention. As shown, the pair of pants 20 does not include one or more wrinkles or indentations 24 when the one or more pant inserts 10 are either temporarily or permanently seated in an operational position within pant pocket 22.

Figure 5D:
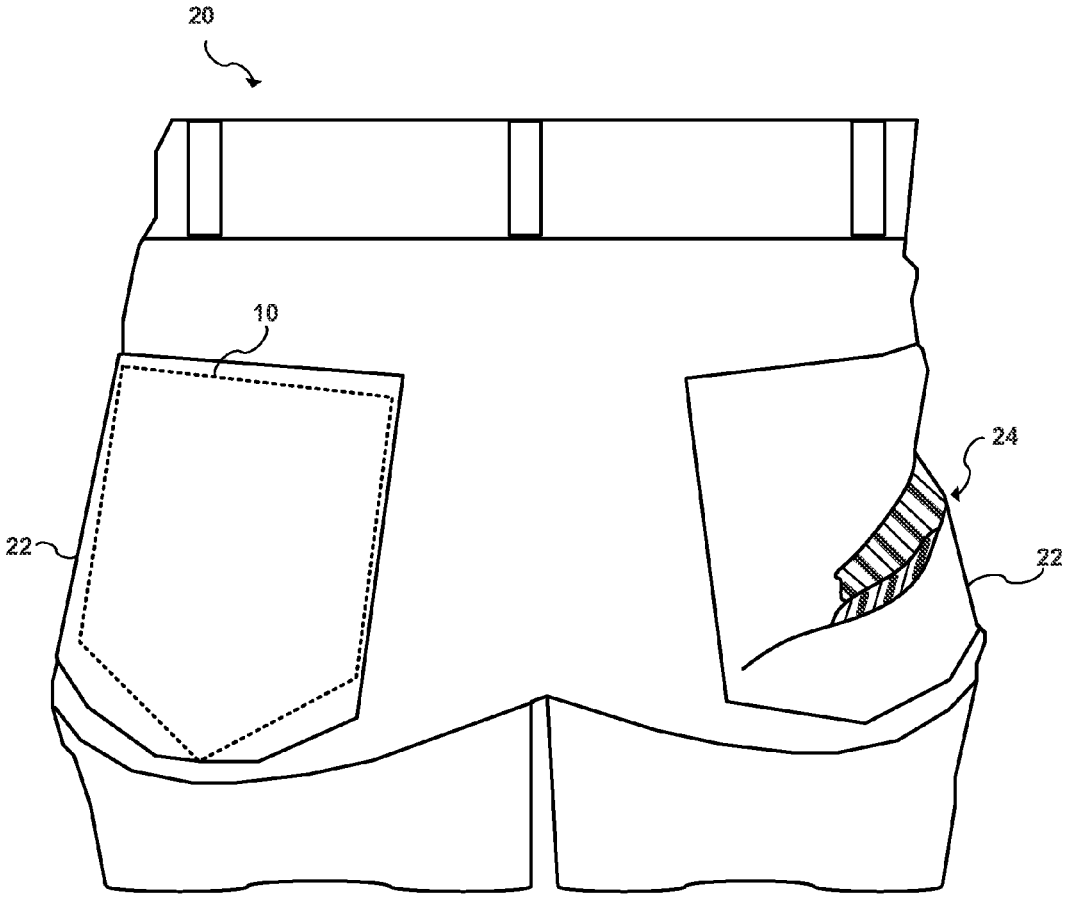
FIG. 5D shows a top plan view of a portion of a pair of pants having a pant insert in an operational position on the left side but not on the right side of the pair of pants in accordance with an embodiment of the present invention.

Referring to FIG. 5D, a top plan view of a portion of a pair of pants having a pant insert in an operational position on the left side but not on the right side of the pair of pants in accordance with an embodiment of the present invention is shown. As shown, the pair of pants 20 has one or more wrinkles or indentations 24 on the side without the pant insert 10 (the right side) either temporarily or permanently seated in an operational position within pant pocket 22.

The pant inserts (100, 100*a*, 100*b* and 100*c*) shown in FIGS. 4A-4D include without limitation: a slender type pant insert 100 with defined diagonal angles, a wider type pant insert 100*a* with defined diagonal angles, a rectangular shaped pant insert 100*b*, and a slender type pant insert 100*c* with defined arches.

Figure 4A:
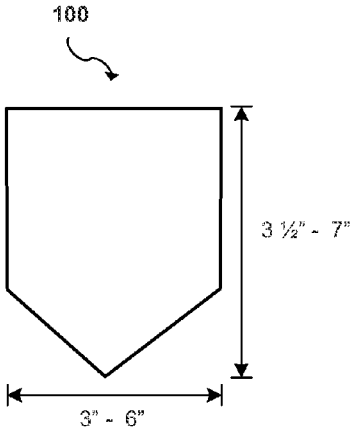
FIG. 4A shows a plan view of a pant insert in accordance with a possible implementation of the present invention.

Referring to FIG. 4A, a plan view of a pant insert 100 in accordance with a possible implementation of the present invention is shown. A slender type pant insert 100 is configured with defined diagonal angles according to this possible implementation. This pant insert configuration is typically used in jean pant pockets. Without limitation, the slender type pant insert 100 ranges from 3 inches to 7 inches in length and 3" to 6" in width. Obviously, however, other sizes are within the scope of the present invention.

Figure 4B:
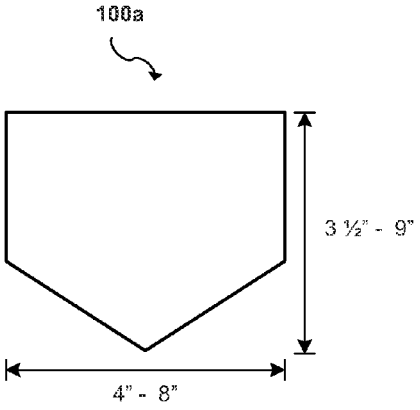
FIG. 4B shows a plan view of a pant insert in accordance with a possible alternate implementation of the present invention.

Referring to FIG. 4B, a plan view of a pant insert 100*a* in accordance with a possible alternate implementation of the present invention is shown. A wider type pant insert 100*a* is configured with defined diagonal angles according to this possible alternate implementation. This pant insert configuration is typically used in jean pant pockets. Without limitation, the wider type pant insert 100*a* ranges from 3 inches to 9 inches in length and 4 inches to 8 inches in width. Obviously, however, other sizes are within the scope of the present invention.

Figure 4C:
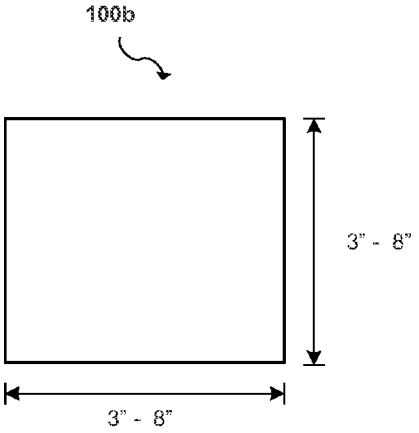
FIG. 4C shows a plan view of a pant insert in accordance with a possible alternate implementation of the present invention.

Referring to FIG. 4C, a plan view of a pant insert 100 in accordance with a possible alternate implementation of the present invention is shown. A rectangular shaped pant insert 100*b* is configured according to this possible implementation. This pant insert configuration is typically used in pant pockets for slacks, shorts and capris. Without limitation, the rectangular shaped pant insert 100*b* ranges from 3½ inches to 9 inches in length, and 4 inches to 8 inches in width. Obviously, however, other sizes are within the scope of the present invention.

Figure 4D:
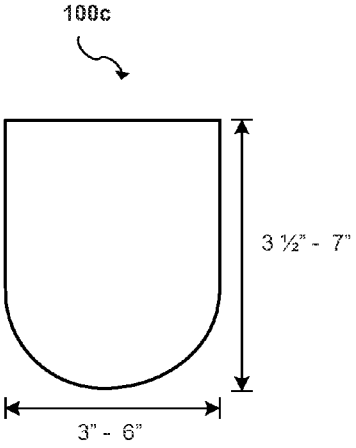
FIG. 4D shows a plan view of a pant insert in accordance with a possible alternate implementation of the present invention.

Referring to FIG. 4D, a plan view of a pant insert 100 in accordance with a possible alternative implementation of the present invention is shown. A slender type pant insert 100*c* is configured with defined arches according to this possible alternate implementation. This pant insert configuration is typically used in jean pant pockets. Without limitation, the slender type pant insert 100*c* ranges from 3½ inches to 7 inches in length and 3" to 6" in width. Obviously, however, other sizes are within the scope of the present invention.

II. Pant Insert Layers

Permanent Four-Layer Wearable Fabric

Figure 1D:
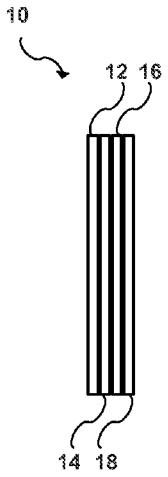
FIG. 1D shows a side view of a pant insert having one or more pant insert layers in accordance with an embodiment of the present invention.

Referring to FIGS. 1A-1D, one or more pant insert layers (12, 14, 16 and 18) in accordance with an embodiment of the present invention are shown. Without limitation, a pant insert 10 includes one or more pant insert layers (12, 14, 16 and 18). Without limitation, one or more pant pocket layers include a wearable fabric layer 12 (layer 1), a fusible/bonding product layer 14 (layer 2), a stiff utility material layer 16 (layer 3) and a fusible/bonding product layer 18 (layer 4). According to one embodiment, the pant insert 10 is formed by bonding together one or more pant insert layers (12, 14, 16 and 18), as shown in FIG. 1D and further described in FIGS. 6A and 6B.

The wearable fabric layer 12 (layer 1) may consist of any fabric material of either natural, synthetic or a natural synthetic blend. This fabric material may be, without limitation comprised of denim, twill, canvas, limen, silk, rayon, wool, satin, polyester, cotton or any other wearable fabric in the textile industry for clothing. The wearable fabric layer 12 (layer 1) may be, but is not limited to, fabric material of the same composition as the clothing item to which it is attached or intended to be attached. The fabric material may also include a color, design or pattern select to match complement, correspond to, or coordinate with the clothing item to which it is attached or intended to be attached. According to one non-limiting embodiment, 100% cotton is used to prevent stretching. The fabric weight may be varied from light to heavy depending on the amount of flexibility desired. According to one possible embodiment, the wearable fabric layer 12 (layer 1) is manufactured by Dritz® and described as a "Denium Iron-On Patching Cloth." According to another possible embodiment, the wearable fabric layer 12 (layer 1) is manufactured by Sew-Ology and described as "Iron On Patches." However, it is understood that other wearable fabric materials may be used within the scope of the present invention.

The fusible/bonding product layer 14 (layer 2) comprises a fusible/bonding material that may include an adhesive or other bonding agent, such as, without limitation, a fusible web. Fusible web is an iron-on adhesive made from a mesh of fibers with adhesive properties. The fibers melt when heated to join two layers of fabric together. There are quite a number of fusible products with different properties but the common element is that they join layers of other fabric together when heated, without sewing. Paper-backed fusibles include Wonder-Under®, Trans-Web™, and Heatn-Bond®. Steam a Seam2® and Lite Steam a Seam2® are also paper backed fusibles, however, there are differences from the other paper-backed fusibles. The Steam a Seam products have two pieces of release paper, one on each side of the web, and are called "double stick". The Steam-a-Seam products will stick to the fabric in a temporary bond which allows one to reposition the applique before sewing. Mistyfuse® is another fusible web product that adheres two layers of fabric together. Mistyfuse® performs the same function as other fusible web products but is very sheer, light weight and does not add stiffness or bulk to the layers of fabric joined. Mistyfuse® does not have a paper backing and can be used with very sheer fabrics and lower temperatures. Stitch Witchery is a fusible web without a paper backing. It can be used in a manner similar to Mistyfuse®, but is heavier in weight.

According to one possible embodiment, the fusible/bonding product layer 14 (layer 2) is manufactured by Pellon and James Thompson & Company. It is understood that other similar products may be used within the scope of the present invention. According to one possible embodiment, the fusible/bonding product layer 14 (layer 2) is manufactured by Pellon under the name Wonder-Under®. However, it is understood that other fusible/bonding materials may be used within the scope of the present invention. The product weight may be varied from light to heavy depending on the type of fabric. Heavy weight is recommended for heavy fabrics, such as, without limitation, denim and twill. According to one embodiment, the fusible/bonding product layer 14 (layer 2) has a rough side and a paper backing on the opposite side. The rough side of the fusible/bonding product layer 14 (layer 2) is used to fuse one side. The paper backing on the opposite side of the fusible/bonding product layer 14 (layer 2) is peeled and that side is then fused. According to an alternate embodiment, the fusible/bonding product layer 14 (layer 2) may be a sheet of material with any adhesive or bonding agent either on the material itself or applied at the time of bonding. According to another alternate embodiment, the fusible/bonding product layer 14 (layer 2) may be a sheet of material that is sewn or stitched or otherwise attached to the other layers.

The stiff utility material layer 16 (layer 3) is without limitation comprised of a stiffening material which has the capability to maintain form while having flexibility and stiffness, such as, without limitation, stiffeners used with collars and cuffs. According to one possible embodiment, the stiff utility material layer 16 (layer 3) is manufactured by Pellon and James Thompson & Company. It is understood that other similar materials may be used within the scope of the present invention. According to one possible embodiment, the stiff utility material layer 16 (layer 3) is manufactured by Pellon under the name Extra Heavy 65® and James Thompson & Company under the name "Unicorn Buckram." According to another possible embodiment, the stiff utility material layer 16 (layer 3) is manufactured under the names "Vilene L11 Soft Interfacing/Interlining" or "Buckram." According to one embodiment, the stiff utility material layer 16 (layer 3) is comprised of 100% cotton. However, it is understood that other fusible/bonding materials may be used within the scope of the present invention.

The fusible/bonding product layer 18 (layer 4) comprises a fusible/bonding material that may include an adhesive or other bonding agent, such as, without limitation, a fusible web. Fusible web is an iron-on adhesive made from a mesh of fibers with adhesive properties. The fibers melt when heated to join two layers of fabric together. There are quite a number of fusible products with different properties but the common element is that they join layers of other fabric together when heated, without sewing. As discussed above, fusible web products include Wonder-Under®, Trans-Web™, and HeatnBond®. Steam a Seam2® and Lite Steam a Seam2®, Mistyfuse™ and Stitch Witchery.

According to one possible embodiment, the fusible/bonding product layer 18 (layer 4) is manufactured by Pellon and James Thompson & Company. It is understood that other similar products may be used within the scope of the present invention. According to one possible embodiment, the fusible/bonding product layer 18 (layer 4) is manufactured by Pellon under the name Wonder-Under®. However, it is understood that other fusible/bonding materials may be used within the scope of the present invention. The product weight may be varied from light to heavy depending on the type of fabric. Heavy weight is recommended for heavy fabrics, such as, without limitation, denim and twill. According to one embodiment, the fusible/bonding product layer 18 (layer 4) has a rough side and a paper backing on the opposite side. The rough side of the fusible/bonding product layer 18 (layer 4) is used to fuse one side. The paper backing on the opposite side of the fusible/bonding product layer 18 (layer 4) is peeled and that side is then fused. According to an alternate embodiment, the fusible/bonding product layer 18 (layer 4) may be a sheet of material with any adhesive or bonding agent either on the material itself or applied at the time of bonding. According to another alternate embodiment, the fusible/bonding product layer 18 (layer 4) may be a sheet of material that is sewn or stitched or otherwise attached to the other layers.

Figure 2A:
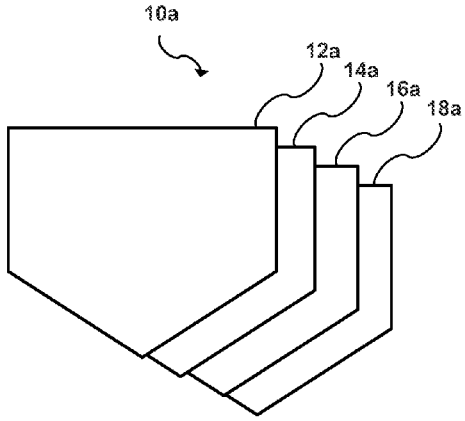
FIG. 2A shows an exploded top plan view of a pant insert having one or more pant insert layers in accordance with an alternate embodiment of the present invention.
Figure 2B:
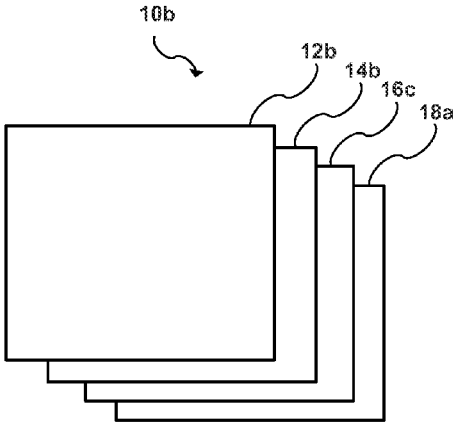
FIG. 2B shows an exploded top plan view of a pant insert having one or more pant insert layers in accordance with an alternate embodiment of the present invention.
Figure 2C:
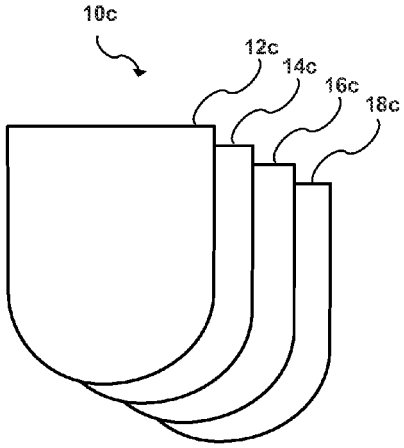
FIG. 2C shows an exploded top plan view of a pant insert having one or more pant insert layers in accordance with an alternate embodiment of the present invention.

Optional exploded top plan view of pant inserts in accordance with alternate embodiments of the present invention are shown in FIGS. 2A-2C.

Two-Layer Self-Bonding Fabric

Figure 3A:
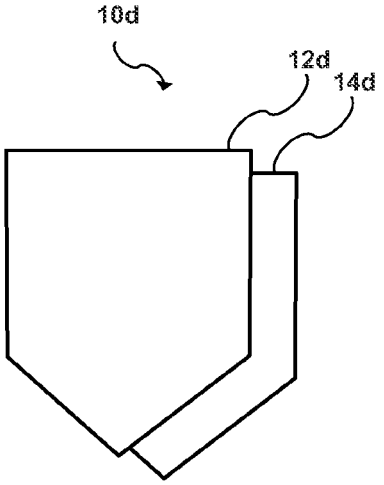
FIG. 3A shows an exploded top plan view of a pant insert having two pant insert layers in accordance with an alternate embodiment of the present invention.
Figure 3B:
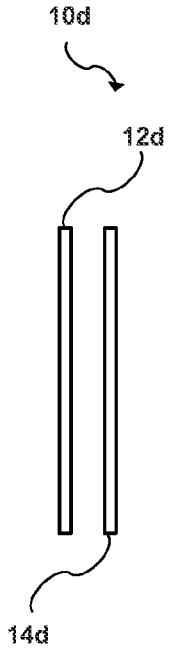
FIG. 3B shows an exploded side view of a pant insert having two pant insert layers in accordance with an alternate embodiment of the present invention.
Figure 3C:
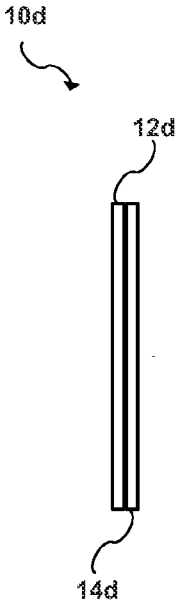
FIG. 3C shows a side view of a pant insert having two pant insert layers in accordance with an alternate embodiment of the present invention.

Referring to FIGS. 3A-3C, a pant insert 10*d* having two pant insert layers (12*d*, 14*d*) in accordance with an alternate embodiment of the present invention are shown. According to this alternate embodiment, without limitation, a pant insert 10*d* includes two pant insert layers. Without limitation, pant insert 10*d* having two pant pocket layers include a self-bonding fabric layer 12*d* (layer 1) and a stiff utility material layer 14*d* (layer 2). The pant insert 10*d* is formed by bonding together two pant insert layers (12*d* and 14*d*), as shown in FIG. 3D.

Five-Layer Wearable Fabric

Figure 3D:
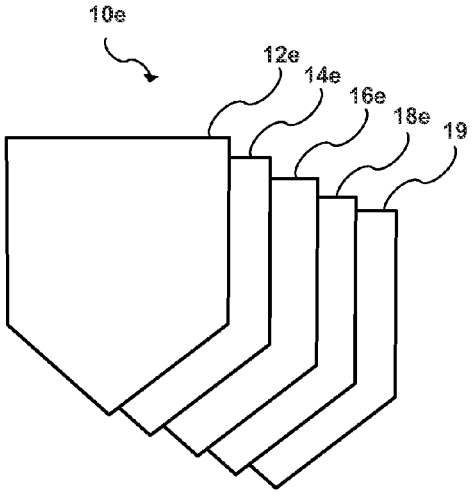
FIG. 3D shows an exploded top plan view of a pant insert having five pant insert layers in accordance with an alternate embodiment of the present invention.
Figure 3E:
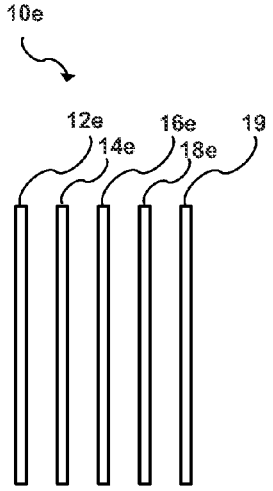
FIG. 3E shows an exploded side view of a pant insert having five pant insert layers in accordance with an alternate embodiment of the present invention.
Figure 3F:
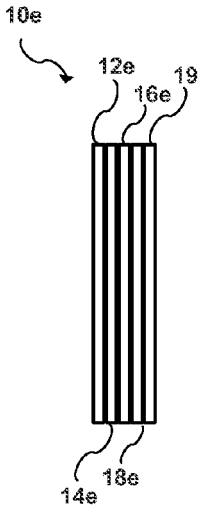
FIG. 3F shows a side view of an alternate pant insert having five pant insert layers in accordance with an alternate embodiment of the present invention.

Referring to FIGS. 3D-3F, a pant insert 10*e* having five pant insert layers (12*e*, 14*e*, 16*e*, 18*e* and 19) in accordance with another alternate embodiment of the present invention is shown. According to this embodiment, without limitation, a pant insert 10*e* includes five pant insert layers. Without limitation, the five pant pocket layers include a wearable fabric layer 12*e* (layer 1), a fusible/bonding product layer 14*e* (layer 2), a padded utility material layer 16*e* (layer 3), a fusible/bonding product layer 18*e* (layer 4), and a stiff utility material layer 19 (layer 5). The pant insert 10*e* is formed by bonding together one or more pant insert layers (12*e*, 14*e*, 16*e*, 18*e* and 19), as shown in FIG. 3F.

The padded utility material layer 16*e* (layer 3) is without limitation approximately $1/16^{th}$ to $1/8^{th}$ of an inch. The material weight may be varied from light to heavy depending on the amount of flexibility desired. This type of material has the capability to maintain form while having flexibility with a slight soft loft, such as applique cut-outs. Batting, such as, without limitation, cotton, polyester, felt or leather batting, may also be used. Batting is a layer of material that is thicker than fabric. According to one possible embodiment, the padded utility material layer 16*e* (layer 3) is manufactured by Pellon under the name "Stabilizer Midwieght" (MDWT). Under this embodiment, the padded utility material layer 16*e* (layer 3) is comprised of 90% polyester and 10% rayon. It is understood that other similar materials may be used within the scope of the present invention.

Permanent Three-Layer Wearable Fabric

Figure 3G:
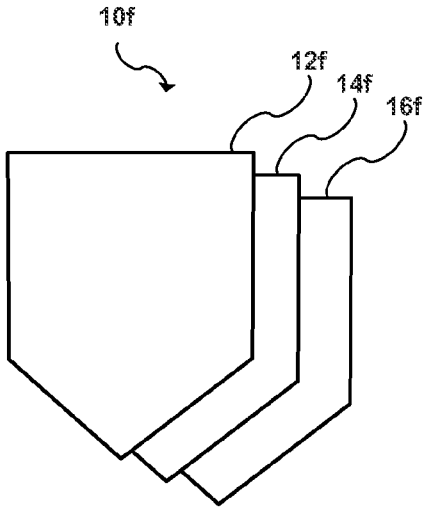
FIG. 3G shows an exploded top plan view of a pant insert having three pant insert layers in accordance with an alternate embodiment of the present invention.
Figure 3H:
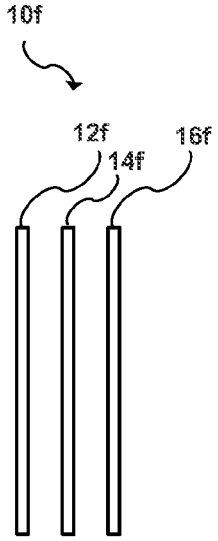
FIG. 3H shows an exploded side view of a pant insert having three pant insert layers in accordance with an alternate embodiment of the present invention.
Figure 3I:
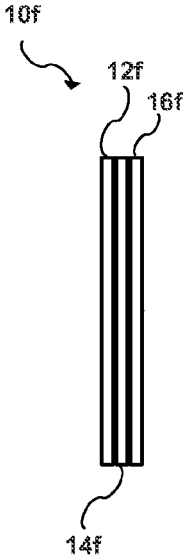
FIG. 3I shows a side view of an alternate pant insert having three pant insert layers in accordance with an alternate embodiment of the present invention.

Referring to FIGS. 3G-3I, a pant insert 10*f* having three pant insert layers (12*f*, 14*f*, 16*f*) in accordance with yet another alternate embodiment of the present invention is shown. Without limitation, a pant insert 10*f* includes one or more pant insert layers (12*f*, 14*f* and 160). Without limitation, one or more pant pocket layers include a wearable fabric layer 12*f* (layer 1), a fusible/bonding product layer 14*f* (layer 2) and a stiff utility material layer 16*f* (layer 3). According to one embodiment, the pant insert 10*f* is formed by bonding together one or more pant insert layers (12*f*, 14*f* and 18*f*), as shown in FIG. 1D and further described in FIGS. 6H and 6I.

Three-Layer Self-Bonding Fabric

Alternatively, referring to FIGS. 3G-3I, a pant insert 10*f* having three pant insert layers (12*f*, 14*f*, 16*f*) in accordance with another alternate embodiment of the present invention is shown. Without limitation, a pant insert 10*f* includes one or more pant insert layers (12*f*, 14*f* and 16*f*). Without limitation, one or more pant pocket layers include a self-bonding fabric layer 12*f* (layer 1), a stiff utility material layer 14*f* (layer 2) and a fusible/bonding product layer 16*f* (layer 3). According to one embodiment, the pant insert 10*f* is formed by bonding together one or more pant insert layers (12*f*, 14*f* and 18*f*), as shown in FIG. 1D and further described in FIGS. 6J and 6K.

Alternates

According to an alternate embodiment, one or more pant inserts 10 or one or more layers thereof are incorporated into, or either temporarily or permanently attached to, the pair of pants 20 such that the one or more pant inserts 10 or one or more layers thereof straighten or take out the creases on the pair of pants 20 in the general area the one or more pant inserts 10 or one or more layers thereof, during the manufacture (or prior to sale) of the pair of pants 20 using techniques and applications described, suggested or implied in, or similar to, the present invention. According to this embodiment, the one or more pant inserts 10 or one or more layers thereof may be incorporated into or attached to the inside or outside of a pant pocket 22, between the inside side of the pant pocket 22 and the pair of pants 20 fabric, or the inside or outside of the pair of pants 20 fabric.

According to another alternate embodiment, one or more of the layers may be sewn or stitched together. According to this embodiment, the layers are sewn or stitched together along the perimeter of the combined layers. However, it is understood that other sewing and/or stitching patterns may be used within the scope of the present invention. Alternatively, the layers may be interconnected (or the pant insert 10 may be connected to the clothing item to which it is attached or intended to be attached) by means of fasteners, in some embodiments, including without limitation, zippers, buttons, hooks, snaps, claps, VELCRO™, laces or any combination of these.

According to yet another alternate embodiment, a flexible plastic sheeting such as, without limitation, a low density polyethylene (LDPE) or linear low density polyethylene (LLDPE), is used instead of one or more of the above described layers. For example, without limitation, a flexible plastic sheeting may be surrounded by one or more pieces of fabric or other layers. Low Density Polyethylene (LDPE) is the most common type of plastic sheeting. It is very flexible, most often from 0.5 mil thick to about 40 mil in flexible sheeting forms. Due to its flexibility is conforms well to a variety of surfaces. LLDPE is the most flexible of the plastic sheeting films. LLDPE is blended form of LDPE where the film has much more flexibility, tensile strength, and more conformability. It is more pliable and softer. LLDPE is used for films that need a tremendous amount of strength to absorb impacts while not tearing or puncturing. It is understood that other similar materials may be used within the scope of the present invention.

III. Tracing and Cutting Pant Insert Layers

Permanent Four-Layer Wearable Fabric

Figure 6A:
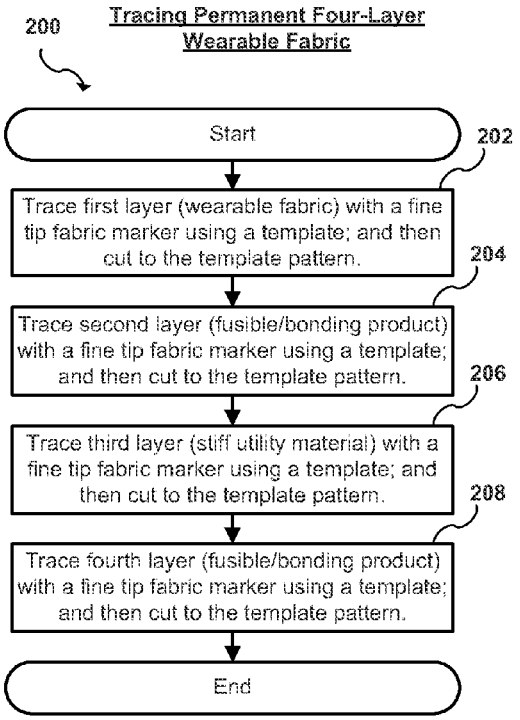
FIG. 6A is a flow chart illustrating a method for tracing and cutting out a pant insert in accordance with an embodiment of the present invention.

Referring to FIG. 6A, a flow chart illustrating a method for tracing and cutting out a pant insert 10 in accordance with an embodiment of the present invention is shown. At block 202, the wearable fabric layer 12 (layer 1) is traced with a fine tip fabric marker using a template, and then cut to the template pattern. The template may be without limitation one of the patterns shown in FIGS. 4A-4D. The fusible/bonding product layer 14 (layer 2) is traced with a fine tip fabric marker using a template, and then cut to the template pattern, at block 204. At block 206, the stiff utility material layer 16 (layer 3) is traced with a fine tip fabric marker using a template, and then cut to the template pattern. The fusible/bonding product layer 18 (layer 4) is traced with a fine tip fabric marker using a template, and then cut to the template pattern, at block 208.

Two-Layer Self-Bonding Fabric

Figure 6B:
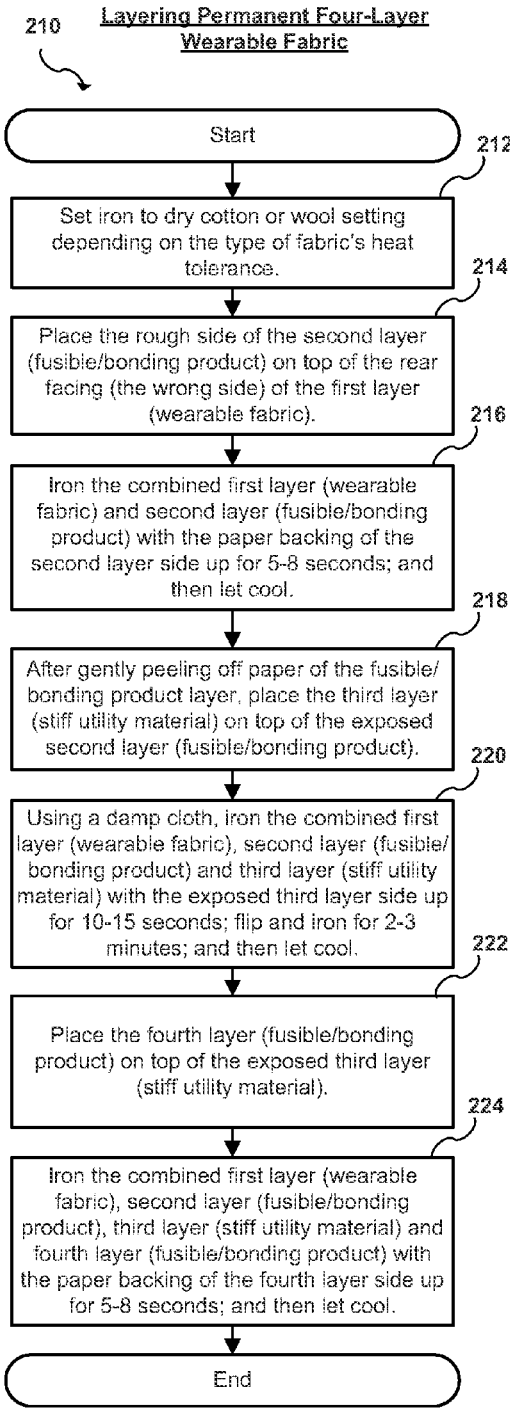
FIG. 6B is a flow chart illustrating a method for layering and bonding a pant insert in accordance with an embodiment of the present invention.
Figure 6C:
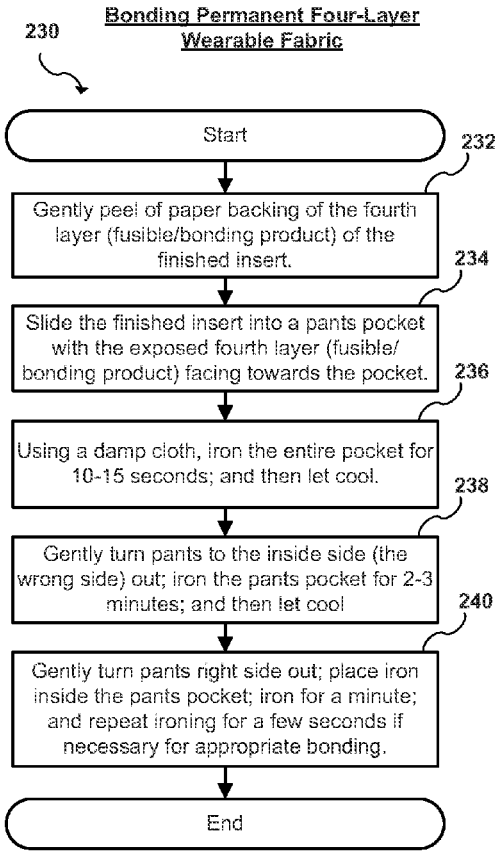
FIG. 6C is a flow chart illustrating a method for permanently bonding a pant insert inside a pants pocket in accordance with an embodiment of the present invention.
Figure 6D:
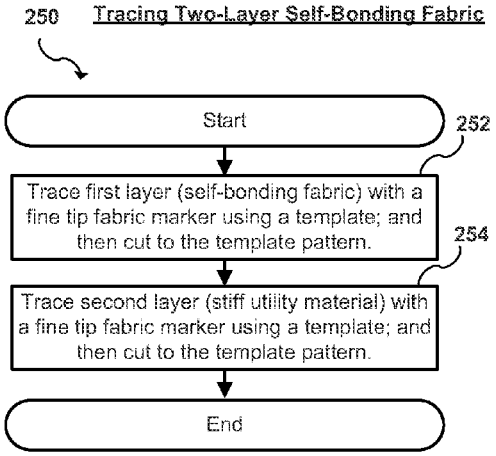
FIG. 6D is a flow chart illustrating a method for tracing and cutting out a pant insert in accordance with an alternate embodiment of the present invention.

Referring to FIG. 6D, a flow chart illustrating a method for tracing and cutting out a pant insert 10*d* in accordance with an alternate embodiment of the present invention is shown. At block 252, the self-bonding fabric layer 12*d* is traced with a fine tip fabric marker using a template, and then cut to the template pattern. The template may be without limitation one of the patterns shown in FIGS. 4A-4D. The fusible/bonding product layer 14*d* (layer 2) is traced with a fine tip fabric marker using a template, and then cut to the template pattern, at block 254.

Five-Layer Wearable Fabric

Figure 6E:
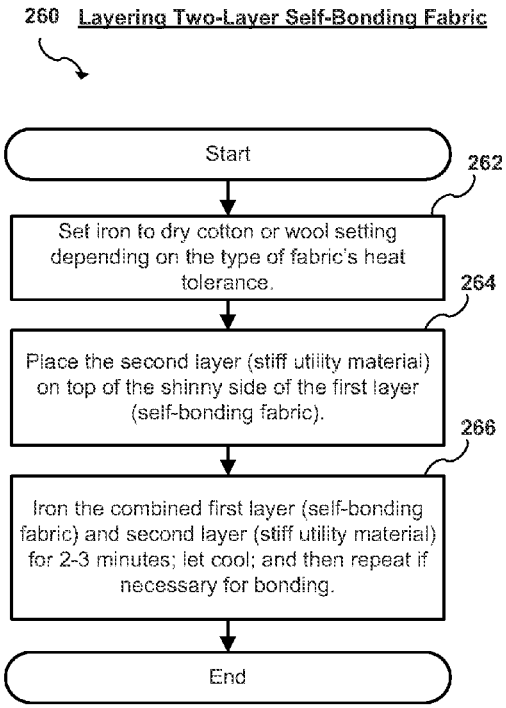
FIG. 6E is a flow chart illustrating a method for layering and bonding a pant insert in accordance with an alternate embodiment of the present invention.
Figure 6F:
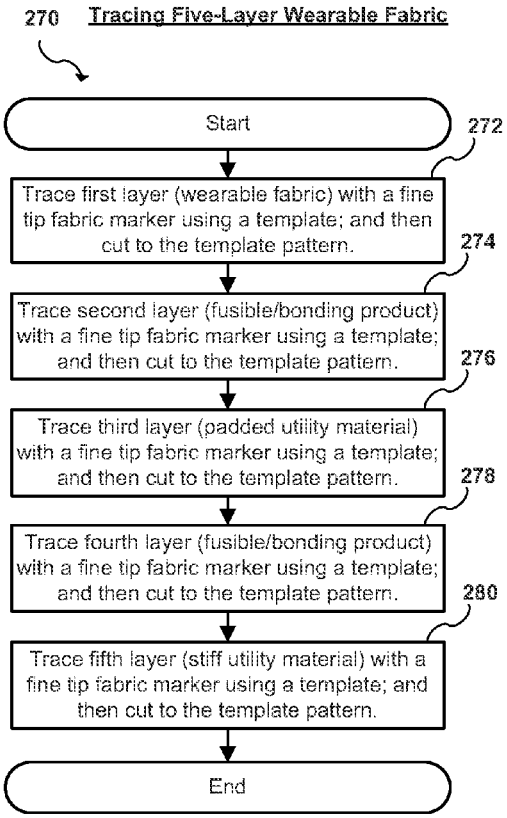
FIG. 6F is a flow chart illustrating a method for tracing and cutting out a pant insert in accordance with another alternate embodiment of the present invention.

Referring to FIG. 6F, a flow chart illustrating a method for tracing and cutting out a pant insert 10*e* in accordance with another alternate embodiment of the present invention is shown. At block 272, the wearable fabric layer 12*e* (layer 1) is traced with a fine tip fabric marker using a template, and then cut to the template pattern. The template may be without limitation one of the patterns shown in FIGS. 4A-4D. The fusible/bonding product layer 14*e* (layer 2) is traced with a fine tip fabric marker using a template, and then cut to the template pattern, at block 274. At block 276, the padded utility material layer 16*e* (layer 3) is traced with a fine tip fabric marker using a template, and then cut to the template pattern. The fusible/bonding product layer 18*e* (layer 4) is traced with a fine tip fabric marker using a template, and then cut to the template pattern, at block 278. At block 280, the stiff utility material layer 19 (layer 5) is traced with a fine tip fabric marker using a template, and then cut to the template pattern.

Permanent Three-Layer Wearable Fabric

Figure 6G:
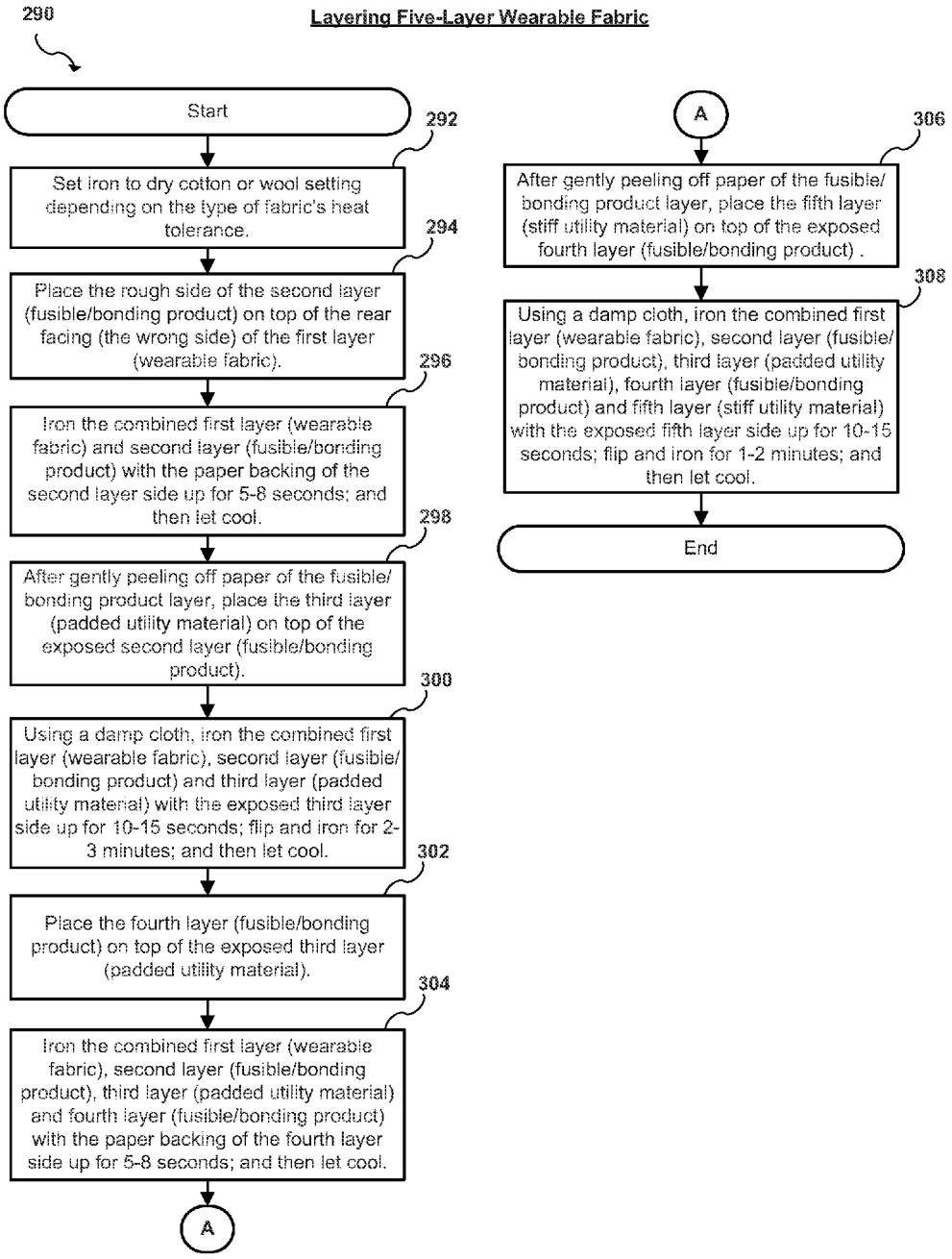
FIG. 6G is a flow chart illustrating a method for layering and bonding a pant insert in accordance with another alternate embodiment of the present invention.
Figure 6H:
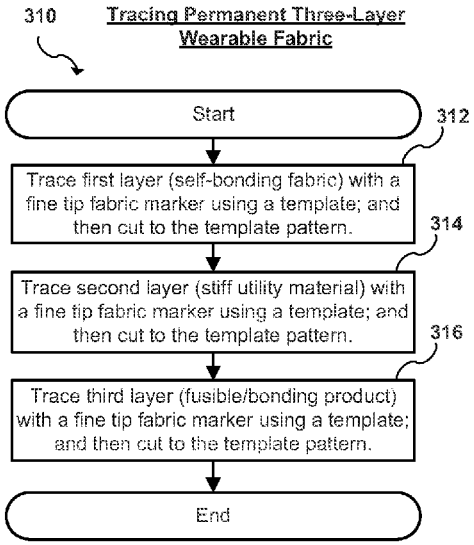
FIG. 6H is a flow chart illustrating a method for tracing and cutting out a pant insert in accordance with yet another alternate embodiment of the present invention.

Referring to FIG. 6H, a flow chart illustrating a method for tracing and cutting out a pant insert in accordance with yet another alternate embodiment of the present invention is shown. At block 312, the self-bonding fabric layer 12*f* (layer 1) is traced with a fine tip fabric marker using a template, and then cut to the template pattern. The template may be without limitation one of the patterns shown in FIGS. 4A-4D. The stiff utility material layer 14*f* (layer 2) is traced with a fine tip fabric marker using a template, and then cut to the template pattern, at block 314. At block 316, the fusible/bonding product layer 16*f* (layer 3) is traced with a fine tip fabric marker using a template, and then cut to the template pattern.

Three-Layer Self-Bonding Fabric

Figure 6I:
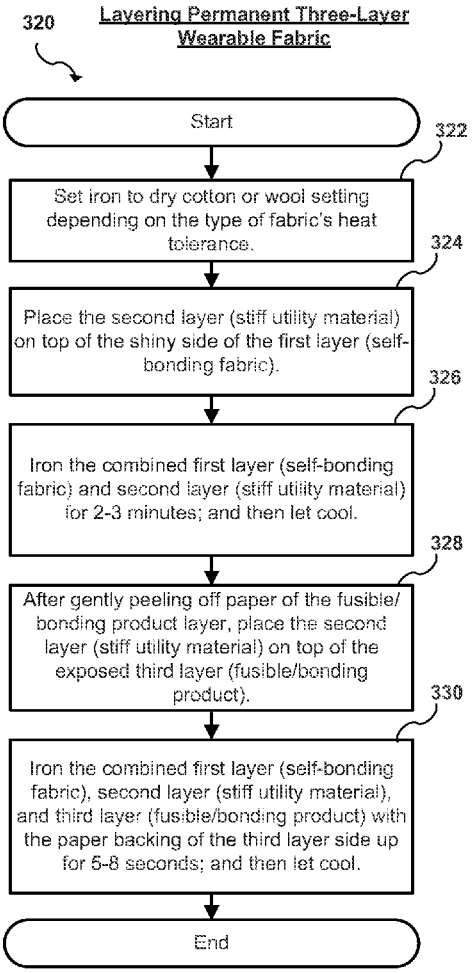
FIG. 6I is a flow chart illustrating a method for layering and bonding a pant insert in accordance with yet another alternate embodiment of the present invention.
Figure 6J:
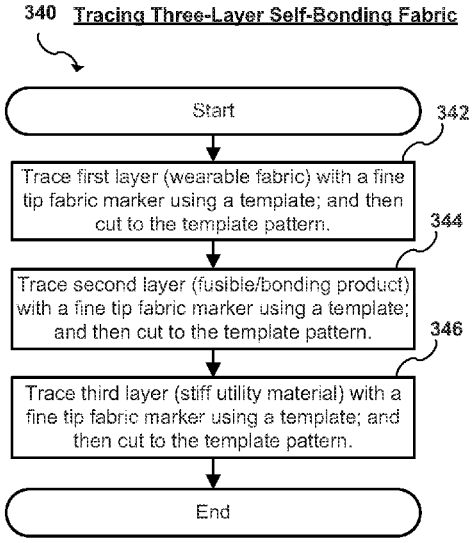
FIG. 6J is a flow chart illustrating a method for tracing and cutting out a pant insert in accordance with another alternate embodiment of the present invention.

Referring to FIG. 6J, a flow chart illustrating a method for tracing and cutting out a pant insert in accordance with another alternate embodiment of the present invention is shown. At block 342, the wearable fabric layer 12*f* (layer 1) is traced with a fine tip fabric marker using a template, and then cut to the template pattern. The template may be without limitation one of the patterns shown in FIGS. 4A-4D. The fusible/bonding product layer 14*f* (layer 2) is traced with a fine tip fabric marker using a template, and then cut to the template pattern, at block 344. At block 346, the stiff utility material layer 16*f* (layer 3) is traced with a fine tip fabric marker using a template, and then cut to the template pattern.

IV. Layering Pant Insert Layers

Permanent Four-Layer Wearable Fabric

Referring to FIG. 6B, a flow chart illustrating a method for layering and bonding a pant insert in accordance with an embodiment of the present invention is shown. At block 212, the iron is set to a dry cotton setting or a wool setting depending on the type of fabric's heat tolerance. The rough side of the fusible/bonding product layer 14 (layer 2) is placed on top of the wrong side of the wearable fabric layer 12 (layer 1), at block 214. At block 216, the combined wearable fabric layer 12 (layer 1) and fusible/bonding product layer 14 (layer 2) are ironed together with the paper backing of the fusible/bonding product layer 14 (layer 2) side up for 5-8 seconds. The combined wearable fabric layer 12 (layer 1) and fusible/bonding product layer 14 (layer 2) are then allowed to cool.

After gently peeling off paper of the fusible/bonding product layer 14 (layer 2), the stiff utility material layer 16 is placed on top of the exposed side of the fusible/bonding product layer 14 (layer 2), at block 218. At block 220, using a damp cloth, the combined wearable fabric layer 12 (layer 1), fusible/bonding product layer 14 (layer 2), and stiff utility material layer 16 (layer 3) are ironed together with the exposed side of the stiff utility material layer 16 (layer 3) side up for 10-15 seconds. The combined wearable fabric layer 12 (layer 1), fusible/bonding product layer 14 (layer 2)

and stiff utility material layer 16 (layer 3) is flipped and ironed for 2-3 minutes, and then allowed to cool.

The fusible/bonding product layer 18 is placed on top of the exposed side of the stiff utility material layer 16 (layer 3), at block 222. At block 224, the combined wearable fabric layer 12 (layer 1), fusible/bonding product layer 14 (layer 2), stiff utility material layer 16 (layer 3), and fusible/bonding product layer 18 are ironed together with exposed stiff utility material layer 16 (layer 3) side up for 5-8 seconds. The combined wearable fabric layer 12 (layer 1), fusible/bonding product layer 14 (layer 2), stiff utility material layer 16 (layer 3), and fusible/bonding product layer 18 are then allowed to cool.

Two-Layer Self-Bonding Fabric

Referring to FIG. 6E, a flow chart illustrating a method for layering and bonding a pant insert 10*d* in accordance with an alternate embodiment of the present invention. At block 262, the iron is set to a dry cotton setting or a wool setting depending on the type of fabric's heat tolerance. The shiny side (rear side of the fabric layer) of the self-bonding fabric layer 12*d* (layer 1) is placed on top of the stiff utility material layer 14*d* (layer 2), at block 264. At block 266, the combined self-bonding fabric layer 12*d* (layer 1) and stiff utility material layer 14*d* (layer 2) are ironed together for 2-3 minutes. The combined self-bonding fabric layer 12*d* (layer 1) and stiff utility material layer 14*d* (layer 2) are then allowed to cool. This step may be repeated if necessary for appropriate bonding. The pant insert is then allowed to cool.

Five-Layer Wearable Fabric

Referring to FIG. 6G, a flow chart illustrating a method for layering and bonding a pant insert 10*e* in accordance with another alternate embodiment of the present invention. At block 292, the iron is set to a dry cotton setting or a wool setting depending on the type of fabric's heat tolerance. The rough side of the fusible/bonding product layer 14*e* (layer 2) is placed on top of the wrong side of the wearable fabric layer 12*e* (layer 1), at block 294. At block 296, the combined wearable fabric layer 12*e* (layer 1) and fusible/bonding product layer 14*e* (layer 2) are ironed together with the paper backing of the fusible/bonding product layer 14*e* (layer 2) side up for 5-8 seconds. The combined wearable fabric layer 12*e* (layer 1) and fusible/bonding product layer 14*e* (layer 2) are then allowed to cool.

After gently peeling off paper of the fusible/bonding product layer 14*e* (layer 2), the padded utility material layer 16*e* (layer 3) is placed on top of the exposed side of the fusible/bonding product layer 14*e* (layer 2), at block 298. At block 300, using a damp cloth, the combined wearable fabric layer 12*e* (layer 1), fusible/bonding product layer 14*e* (layer 2), and padded utility material layer 16*e* (layer 3) are ironed together with the exposed side of the padded utility material layer 16*e* (layer 3) side up 10-15 seconds. The combined wearable fabric layer 12*e* (layer 1), fusible/bonding product layer 14*e* (layer 2) and padded utility material layer 16*e* is flipped and ironed for 2-3 minutes, and then allowed to cool.

The fusible/bonding product layer 18*e* (layer 4) is placed on top of the exposed side of the padded utility material layer 16*e* (layer 3), at block 302. At block 304, the combined wearable fabric layer 12*e* (layer 1), fusible/bonding product layer 14*e* (layer 2), padded utility material layer 16*e* (layer 3), and fusible/bonding product layer 18*e* (layer 4) are ironed together with the exposed padded utility material layer 16*e* (layer 3) side up for 5-8 seconds. The combined wearable fabric layer 12*e* (layer 1), fusible/bonding product layer 14*e* (layer 2), padded utility material layer 16*e* (layer 3), and fusible/bonding product layer 18*e* (layer 4) are then allowed to cool.

After gently peeling off paper of the fusible/bonding product layer 18*e* (layer 4), the stiff utility material layer 19 (layer 5) is placed on top of the exposed side of the fusible/bonding product layer 18*e* (layer 4), at block 306. At block 308, the combined wearable fabric layer 12*e* (layer 1), fusible/bonding product layer 14*e* (layer 2), padded utility material layer 16*e* (layer 3), fusible/bonding product layer 18*e* (layer 4) and stiff utility material layer 19 are ironed together with the exposed fusible/bonding product layer 18*e* (layer 4) side up for 5-8 seconds. The combined wearable fabric layer 12*e* (layer 1), fusible/bonding product layer 14*e* (layer 2), padded utility material layer 16*e* (layer 3), fusible/bonding product layer 18*e* (layer 4) and stiff utility material layer 19 (layer 5) are then allowed to cool.

Permanent Three-Layer Wearable Fabric

Referring to FIG. 6I, a flow chart illustrating a method for layering and bonding a pant insert 100*f* in accordance with yet another alternate embodiment of the present invention. At block 322, the iron is set to a dry cotton setting or a wool setting depending on the type of fabric's heat tolerance. The shiny side (rear side of the fabric layer) of the self-bonding fabric layer 12*f* (layer 1) is placed on top of the stiff utility material layer 14*f* (layer 2), at block 324. At block 326, the combined self-bonding fabric layer 12*f* (layer 1) and stiff utility material layer 14*f* (layer 2) are ironed together for 2-3 minutes. The combined self-bonding fabric layer 12*f* (layer 1) and stiff utility material layer 14*f* (layer 2) are then allowed to cool.

After gently peeling off paper of the fusible/bonding product layer 16*f* (layer 3), the stiff utility material layer 14*f* (layer 2) is placed on top of the exposed side of the fusible/bonding product layer 16*f* (layer 3), at block 328. At block 330, the combined self-bonding fabric layer 12*f* (layer 1), stiff utility material layer 14*f* (layer 2), and fusible/bonding product layer 16*f* (layer 3) are ironed together for 5-8 seconds, and then allowed to cool.

Three-Layer Self-Bonding Fabric

Figure 6K:
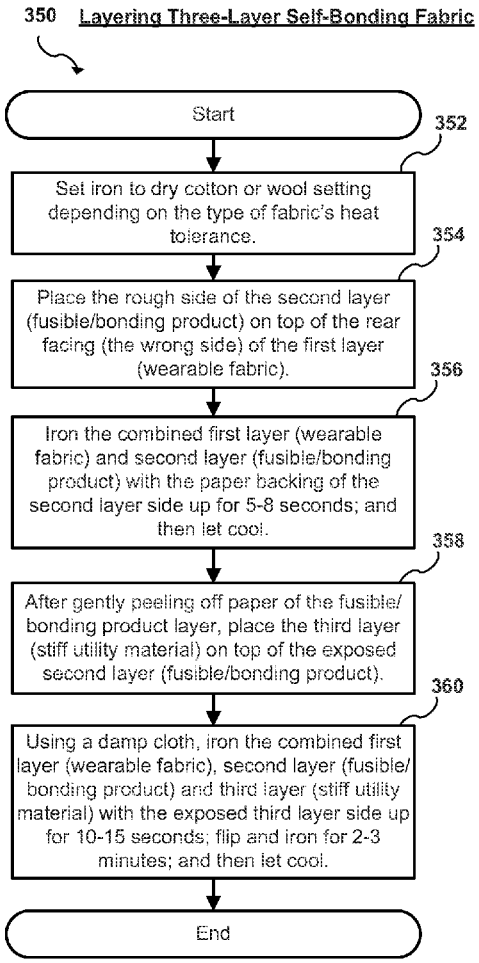
FIG. 6K is a flow chart illustrating a method for layering and bonding a pant insert in accordance with another alternate embodiment of the present invention.

Referring to FIG. 6K, a flow chart illustrating a method for layering and bonding a pant insert in accordance with another alternate embodiment of the present invention is shown. At block 352, the iron is set to a dry cotton setting or a wool setting depending on the type of fabric's heat tolerance. The rough side of the fusible/bonding product layer 14*f* (layer 2) is placed on top of the wrong side of the wearable fabric layer 12*f* (layer 1), at block 354. At block 356, the combined wearable fabric layer 12*f* (layer 1) and fusible/bonding product layer 14*f* (layer 2) are ironed together with the paper backing of the fusible/bonding product layer 14*f* (layer 2) side up for 5-8 seconds. The combined wearable fabric layer 12*f* (layer 1) and fusible/bonding product layer 14*f* (layer 2) are then allowed to cool.

After gently peeling off paper of the fusible/bonding product layer 14*f* (layer 2), the stiff utility material layer 16*f* (layer 3) is placed on top of the exposed side of the fusible/bonding product layer 14*f* (layer 2), at block 358. At block 360, using a damp cloth, the combined wearable fabric layer 12*f* (layer 1), fusible/bonding product layer 14*f* (layer 2), and stiff utility material layer 16*f* (layer 3) are ironed together with the exposed side of the stiff utility material layer 16 (layer 3) side up for 10-15 seconds. The combined wearable fabric layer 12*f* (layer 1), fusible/bonding product layer 14*f* (layer 2) and stiff utility material layer 16*f* (layer 3) is flipped and ironed for 2-3 minutes, and then allowed to cool.

It is understood that the above heating times provided as exemplary times and that other heating times are possible within the scope of the present invention.

V. Permanently Bonding Pant Inserts

Referring to FIG. 6C, a flow chart illustrating a method for permanently bonding a pant insert 10 inside a pants pocket in accordance with an embodiment of the present invention is shown. At block 232, the paper backing of the fusible/bonding product layer 18 (layer 4) of the finished pant insert is gently peeled back. The finished pant insert is slid into a pants pocket with the exposed fusible/bonding product layer 18 (layer 4) facing towards the pocket (not the pants), at block 234. At block 236, the entire pocket is ironed with a damp cloth covering the pant insert 10 for 10-15 seconds. The pant insert 10 is then allowed to cool. The pants are turned to the inside side (the wrong side) of the pants, at block 238. The pants pocket is ironed for 2-3 minutes and then allowed to cool. The pants are turned back to the outside (the normal side), at block 240. The pant pocket is ironed for several seconds. This step may be repeated if necessary for appropriate bonding. The pant insert is then allowed to cool.

The above-identified steps for permanently bonding a pant insert 10 having a permanent four-layer wearable fabric (i.e., FIGS. 1A-1D and 6C) is provided as an example of bonding any pant insert capable of being permanently bonded inside a pant pocket. It is therefore understood that the above-identified steps for permanently bonding a pant insert 10 having a permanent four-layer wearable fabric would be the same as a pant insert having other variations of layers that are capable of being permanently bonded (e.g., the pant insert 10*f* having a permanent three-layer wearable fabric shown in FIGS. 3G-3I and described above).

It is understood that the above heating times for both the layering and the permanent bonding provided as exemplary times and that other heating times are possible within the scope of the present invention.

The above-identified pant inserts having different layers are provided as examples of possible layering to straighten or take out the creases on the article of clothing in the general area of the pant insert when in contact with an article of clothing during an operational use thereof. It is understood that other layering variations are possible within the scope of the present invention.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

Obviously, many other modifications and variations of the present invention are possible in light of the above teachings. The specific embodiments discussed herein are merely illustrative, and are not meant to limit the scope of the present invention in any manner. It is therefore to be understood that within the scope of the disclosed concept, the invention may be practiced otherwise then as specifically described.

The invention claimed is:

1. A system for an improved appearance of a pair of pants, comprising:

a pair of pants having an outer side facing away from a wearer and an inner side facing the wearer when worn, a rear portion adapted to be positioned adjacent to a buttock portion of the wearer when worn, and one or more rear pant pockets each generally having the same shape and size and arranged on the outer side of the pair of pants positioned at the rear portion of the pair of pants; and one or more pant inserts generally resembling the shape and size of the one or more rear pant pockets having an inner side facing the wearer and an outer side facing away from the wearer when worn, with a generally rectangular portion defined by a plurality of edges with one of the edges longitudinally extending from the generally rectangular portion to defined inwardly inclined intersecting diagonal angles and designed to be inserted entirely within and engage respective one or more rear pant pockets during an operational use thereof such that the one or more pant inserts are not externally visible with respect to the outer side of the pair of pants and straighten or take out the creases in the general area of the respective one or more rear pant pockets, and such that the one or more pant inserts stay in place in the respective one or more rear pant pockets, wherein the outer and inner sides of the one or more pant inserts are substantially flat and comprise a wearable fabric layer and a stiff utility material layer bonded together.

2. The system of claim 1, wherein the one or more pant inserts further comprise a first fusible or bonding product layer and a second fusible or bonding product layer, and wherein the one or more pant inserts have a length ranging from 3½ inches to 9 inches, and a width ranging from 3 inches to 8 inches.

3. The system of claim 2, wherein the one or more pant inserts further comprise a padded utility material layer.

4. The system of claim 2, wherein the material of the one or more pant inserts are at least one selected from group one consisting of denim, twill and a wearable fabric.

5. The system of claim 2, wherein the wearable fabric layer is bonded to a side of the stiff utility material layer.

6. The system of claim 2, wherein the wearable fabric layer is bonded to a side of the first fusible or bonding product layer, a side of the stiff utility material layer is bonded to an opposite side of the first fusible or bonding product layer, and the second fusible or bonding product layer is bonded to an opposite side of the side of the stiff utility material layer.

7. The system of claim 3, wherein the wearable fabric layer is bonded to a side of the first fusible or bonding product layer, a side of the padded utility material layer is bonded to an opposite side of the first fusible or bonding product layer, and a side of the second fusible or bonding product layer is bonded to an opposite side of the side of the padded utility material layer, the stiff utility material layer is bonded to an opposite side of the second fusible or bonding product layer.

8. The system of claim 3, wherein the one or more pant inserts are permanently bonded to an inner portion of the respective one or more rear pant pockets.

9. The system of claim 3, wherein the wearable fabric layer, the stiff utility material layer, and the padded utility material layer are heat bonded together.

10. The system of claim 3, wherein the wearable fabric layer, the stiff utility material layer, and the padded utility material layer are bonded together by means of sewing or stitching.

11. The system of claim 3, wherein the wearable fabric layer, the stiff utility material layer, and the padded utility material layer are bonded together by means of an adhesive.

12. The system of claim 3, wherein one or more of the wearable fabric layer, the stiff utility material layer, and the padded utility material layer comprise a flexible plastic sheeting.

13. The system of claim 3, wherein the one or more pant inserts comprises a color or design selected to match, complement, or correspond to the pair of pants.

14. An insert for use with a pair of pants, comprising:

a pair of pants having an outer side facing away from a wearer and an inner side facing the wearer when worn, a rear portion adapted to be positioned adjacent to a buttock portion of the wearer when worn, and one or more rear pant pockets each generally having the same shape and size and arranged on the outer side of the pair of pants positioned at the rear portion of the pair of pants;

an insert generally having the same shape and size as the at least one rear pocket with a generally rectangular portion defined by a plurality of edges with one of the edges longitudinally extending from the generally rectangular portion to an arched portion and designed to be seated entirely within the at least one rear pocket without being externally visible with respect to the outer side of the pair of pants and to straighten or take out the creases on the pair of pants in the general area of the insert when in contact with the pair of pants during an operational use thereof, and the insert stays in place in the rear pant pocket, an outer side facing away from the wearer and an inner side facing the wearer when worn of the insert being substantially flat and comprising a wearable fabric layer, a first fusible or bonding product layer, a stiff utility material layer, and a second fusible or bonding product layer, wherein the wearable fabric layer, the first fusible or bonding product layer, the stiff utility material layer, and the second fusible or bonding product layer are each bonded together;

wherein the wearable fabric layer comprises at least one selected from the group consisting of denim, twill, canvas, limen, silk, rayon, wool, satin, polyester, and cotton, wherein the first fusible or bonding product layer and second fusible or bonding product layer comprise at least one selected from the group consisting of a sheet of material and an adhesive, a bonding agent, and a fusible web, and wherein the stiff utility material layer comprises a stiffening material configured to maintain form while having flexibility and stiffness.

* * * * *